US008421571B2

(12) United States Patent
Noda et al.

(10) Patent No.: US 8,421,571 B2
(45) Date of Patent: Apr. 16, 2013

(54) TRANSFORMER

(75) Inventors: Toshihiro Noda, Chiyoda-ku (JP); Tetsuya Matsuda, Chiyoda-ku (JP); Hiroshi Kiuchi, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/133,506

(22) PCT Filed: Feb. 13, 2009

(86) PCT No.: PCT/JP2009/052381

§ 371 (c)(1),
(2), (4) Date: Jun. 8, 2011

(87) PCT Pub. No.: WO2010/092676

PCT Pub. Date: Aug. 19, 2010

(65) Prior Publication Data

US 2011/0248813 A1 Oct. 13, 2011

(51) Int. Cl.
*H01F 27/28* (2006.01)

(52) U.S. Cl.
USPC ..... 336/170

(58) Field of Classification Search ..... 336/65, 336/83, 170, 178, 180–184, 212, 220, 214–215
See application file for complete search history.

(56) References Cited

U.S. PATENT DOCUMENTS

| | | | | |
|---|---|---|---|---|
| 6,894,596 | B2 * | 5/2005 | Suzuki | 336/83 |
| 7,345,565 | B2 * | 3/2008 | Yang et al. | 336/200 |
| 7,456,719 | B2 * | 11/2008 | Suzuki et al. | 336/198 |
| 7,642,889 | B2 * | 1/2010 | Suzuki et al. | 336/198 |

FOREIGN PATENT DOCUMENTS

| | | | |
|---|---|---|---|
| JP | 56-61109 | A | 5/1981 |
| JP | 1-155607 | A | 6/1989 |
| JP | 2-184007 | A | 7/1990 |
| JP | 9-134823 | A | 5/1997 |
| WO | WO 93/14508 | A1 | 7/1993 |
| WO | WO 2008/084757 | A1 | 7/2008 |

OTHER PUBLICATIONS

International Search Report (PCT/ISA/210) issued on May 26, 2009, by Japanese Patent Office as the International Searching Authority for International Application No. PCT/JP2009/052381.

* cited by examiner

*Primary Examiner* — Tuyen Nguyen
(74) *Attorney, Agent, or Firm* — Buchanan Ingersoll & Rooney PC

(57) ABSTRACT

A transformer includes the first iron core having a plurality of legs arranged spaced apart from each other; a plurality of high-voltage side coils wound around the plurality of legs, respectively, and receiving a common single-phase AC power; and a plurality of low-voltage side coils provided corresponding to the high-voltage side coils, magnetically coupled to the corresponding high-voltage side coils, and wound around the plurality of legs, respectively. The high-voltage side coils and the corresponding low-voltage side coils constitute a plurality of coil groups. The transformer further includes the second iron core provided between the coil groups adjacent to each other.

6 Claims, 16 Drawing Sheets

TRANSFORMER

TECHNICAL FIELD

The present invention relates to a transformer, and particularly to a transformer designed to allow a reduction in height.

BACKGROUND ART

Conventionally, railroad vehicles such as a Shinkansen bullet train are required to travel at a higher speed and to have the maximum possible transportation capacity. This necessitates a reduction in size and weight of the vehicle body and its ancillary devices, whereas the vehicle-mounted transformer that is particularly large in mass among other ancillary devices has been increased in capacity.

In recent years, there are increasing demands for a low-floor vehicle for the purpose of achieving a barrier-free design. Accordingly, with regard to the underfloor device such as a vehicle-mounted transformer disposed under the floor of the vehicle such as an alternating-current (AC) electric train, there is not only a demand for a reduction in size and weight, but also a strong demand to lower the height of the device for the purpose of achieving a lower-floor vehicle.

For example, Japanese Patent Laying-Open No. 9-134823 (Patent Document 1) discloses a core-type vehicle-mounted transformer as described below. This core-type vehicle-mounted transformer that is cooled by a oil-feeding/air-cooling mechanism is configured to have an inner structure in which a low-voltage winding is wound around the outer periphery of a leg of the iron core and a high-voltage winding is wound around the outer periphery of the low-voltage winding while a cooling oil path is formed between the windings. The inner structure is disposed within a tank such that the above-described cooling oil path extends in parallel to the bottom of the tank. Furthermore, the iron core has two legs, and the low-voltage and high-voltage windings each are divided and wound around the corresponding one of the legs. Since each of the windings is divided into two pieces, the capacity of each winding is reduced by half. As the winding conductor is decreased in size accordingly, the size of one winding in the radial direction is decreased. Consequently, the transformer can be entirely decreased in height, and thus, can be decreased in size.

Patent Document 1: Japanese Patent Laying-Open No. 9-134823

DISCLOSURE OF THE INVENTION

Problems to be Solved by the Invention

For example, in the configuration in which the low-voltage windings divided and wound as described above are connected to different motors, when one motor is faulty, the current is prevented from flowing through the low-voltage winding and high-voltage winding corresponding to the faulty motor. In this case, no magnetic flux is generated in these low-voltage winding and high-voltage winding, which may cause a decrease in the reactance of each winding corresponding to the faulty motor.

However, the vehicle-mounted transformer disclosed in Patent Document 1 does not have a configuration for solving the above-described problems.

The present invention has been made to solve the above-described problems. An object of the present invention is to provide a transformer having a reduced height and capable of preventing a decrease in the reactance.

Means for Solving the Problems

A transformer according to an aspect of the present invention includes a first iron core having a plurality of legs arranged spaced apart from each other; a plurality of high-voltage side coils wound around the plurality of legs, respectively, and receiving a common single-phase alternating-current (AC) power; a plurality of low-voltage side coils provided corresponding to the high-voltage side coils, magnetically coupled to the corresponding high-voltage side coils and wound around the plurality of legs, respectively. The high-voltage side coils and the corresponding low-voltage side coils constitute a plurality of coil groups. The transformer further includes a second iron core provided between the coil groups adjacent to each other.

Preferably, the first iron core and the second iron core are provided separately from each other.

Preferably, the first iron core and the second iron core are integrated with each other.

Preferably, the iron core has at least three openings. The plurality of legs each are provided between the openings. The low-voltage side coil and the high-voltage side coil in each of the coil groups are wound around the leg through each of the openings on both sides of the leg and stacked in a direction in which the leg extends.

Preferably, the low-voltage side coils in the coil groups are coupled to different loads.

Preferably, a minimum value of a length of the second iron core in a direction in which the legs are arranged is determined based on a number of turns of the low-voltage side coil in the coil group adjacent to the second iron core, a current flowing through the low-voltage side coil in the coil group adjacent to the second iron core, a size of each of the low-voltage side coil and the high-voltage side coil in the coil group adjacent to the second iron core, and a saturation magnetic flux density of the second iron core.

A transformer according to another aspect of the present invention includes a first iron core having a plurality of legs; a high-voltage side coil; and a low-voltage side coil. The low-voltage side coil and the high-voltage side coil are divided into a plurality of coil groups. The low-voltage side coil and the high-voltage side coil in each of the plurality of coil groups are wound around a corresponding one of the plurality of legs. The high-voltage side coil in each of the coil groups receives a common single-phase AC power. The low-voltage side coil and the high-voltage side coil in each of the coil groups are magnetically coupled to each other. The transformer further includes a second iron core provided between the coil groups adjacent to each other.

Effects of the Invention

The present invention allows a reduction in the height of the transformer and also allows prevention of a decrease in the reactance.

BRIEF DESCRIPTION OF THE DRAWINGS

FIG. 4(*b*) is a graph showing the leakage magnetic flux generated within an iron core in the transformer.

FIG. 12(*b*) is a graph of the leakage magnetic flux generated within the iron core in the transformer.

DESCRIPTION OF THE REFERENCE SIGNS

Figure 1:
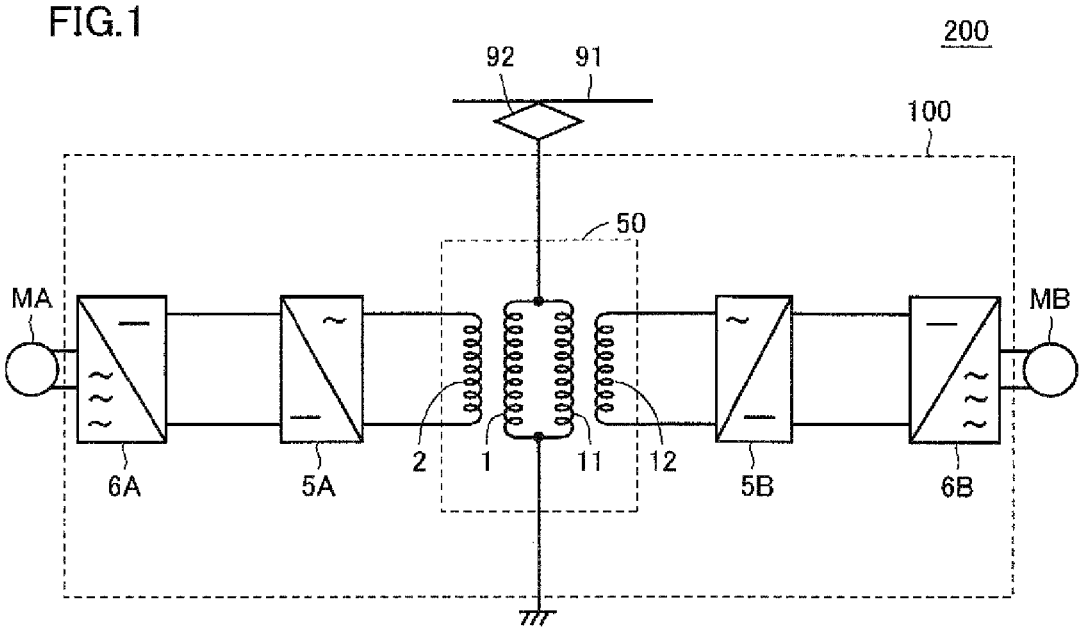
FIG. 1 is a circuit diagram showing the configuration of an AC electric train according to the first embodiment of the present invention.

1, 11, 1A, 1B, 11A, 11B, 41A, 41B high-voltage side coil, 2, 12, 2A, 2B, 12A, 12B, 42A, 42B low-voltage side coil, 5A, 5B, 5C, 5D converter, 6A, 6B, 6C, 6D inverter, 15, 16, 17 sub-iron core, 31, 32, 33, 34 leg, 50, 51, 53, 54, 55, 56 transformer, 60 iron core, 61, 62, 63 main iron core 91 overhead wire, 92 pantograph, 100, 101, 105, 106 transformation apparatus, 200, 201, 205, 206 AC electric train, MA, MB, MC, MD motor, W1, W2, W3, W4, W5 window, G1, G2, G3, G4 coil group

BEST MODES FOR CARRYING OUT THE INVENTION

The embodiments of the present invention will be hereinafter described with reference to the accompanying drawings, in which the same or corresponding components are designated by the same reference characters, and description thereof will not be repeated.

First Embodiment

The explanation will be first made about the configuration in which each coil in a transformer is not divided, which is followed by the explanation of the configuration in which each coil in the transformer is divided.

FIG. 1 is a circuit diagram showing the configuration of an AC electric train according to the first embodiment of the present invention.

Referring to FIG. 1, an AC electric train 200 includes a pantograph 92, a transformation apparatus 100, and motors MA and MB. Transformation apparatus 100 includes a transformer 50, converters 5A and 5B, and inverters 6A and 6B. Transformer 50 includes high-voltage side coils 1, 11 and low-voltage side coils 2, 12.

Pantograph 92 is connected to an overhead wire 91. High-voltage side coil 1 has the first end connected to pantograph 92 and the second end connected to a ground node to which a ground voltage is supplied. High-voltage side coil 11 has the first end connected to pantograph 92 and the second end connected to a ground node to which a ground voltage is supplied.

Low-voltage side coil 2 is magnetically coupled to high-voltage side coil 1. Low-voltage side coil 2 has the first end connected to the first input terminal of converter 5A and the second end connected to the second input terminal of converter 5A. Low-voltage side coil 12 is magnetically coupled to high-voltage side coil 11. Low-voltage side coil 12 has the first end connected to the first input terminal of converter 5B and the second end connected to the second input terminal of converter 5B.

The single-phase AC voltage supplied from overhead wire 91 is supplied via pantograph 92 to high-voltage side coils 1 and 11.

The AC voltage supplied to high-voltage side coils 1 and 11 induces an AC voltage in low-voltage side coils 2 and 12, respectively.

Converter 5A converts the AC voltage induced in low-voltage side coil 2 into a direct-current (DC) voltage. Converter 5B converts the AC voltage induced in low-voltage side coil 12 into a DC voltage.

Inverter 6A converts the DC voltage supplied from converter 5A into a three-phase AC voltage, and outputs the voltage to motor MA. Inverter 6B converts the DC voltage supplied from converter 5B into a three-phase AC voltage, and outputs the voltage to motor MB.

Motor MA is driven based on the three-phase AC voltage supplied from inverter 6A. Motor MB is driven based on the three-phase AC voltage supplied from inverter 6B.

Figure 2:
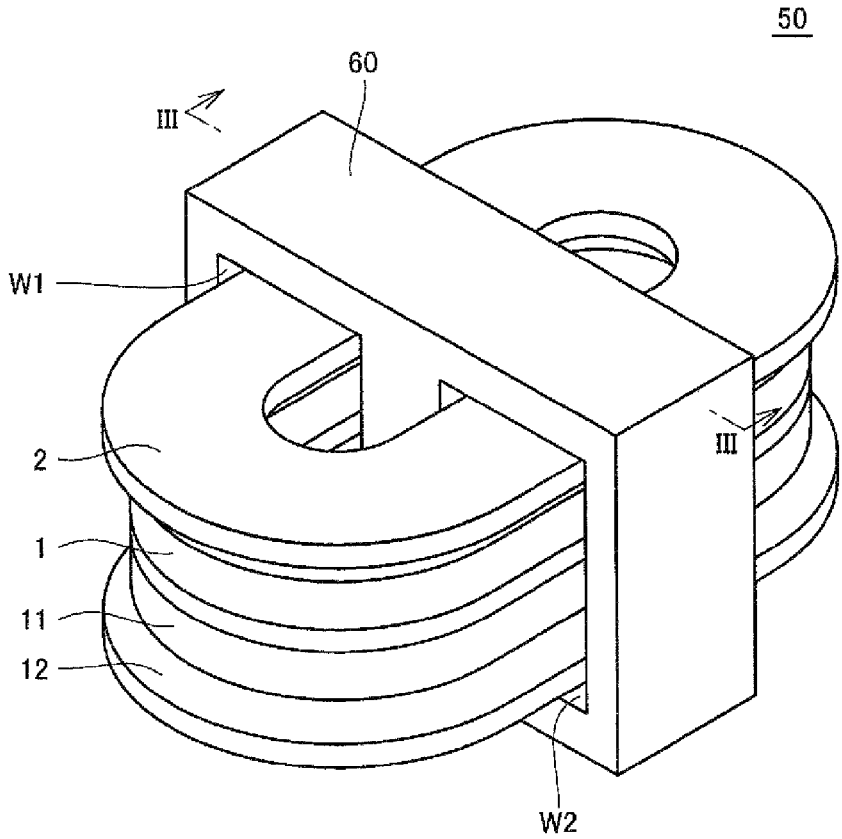
FIG. 2 is a perspective view showing the configuration of a transformer according to the first embodiment of the present invention.

FIG. 2 is a perspective view showing the configuration of the transformer according to the first embodiment of the present invention.

Referring to FIG. 2, transformer 50 is a shell-type transformer, for example. Transformer 50 further includes an iron core 60. Iron core 60 has the first side surface and the second side surface facing each other, and windows W1 and W2 each penetrating from the first side surface through to the second side surface.

High-voltage side coils 1, 11 and low-voltage side coils 2, 12 are wound through windows W1 and W2.

Each of high-voltage side coils 1, 11 and low-voltage side coils 2, 12 includes a plurality of stacked disc windings in the shape of a disc, for example. The disc windings in the adjacent layers are electrically connected to each other. Each disc winding in high-voltage side coils 1 and 11 and low-voltage side coils 2 and 12 is formed by a rectangular conductive line wound in the approximately elliptical shape.

High-voltage side coil 1 is disposed between low-voltage side coil 2 and low-voltage side coil 12 so as to face low-voltage side coil 2. High-voltage side coil 1 is also magnetically coupled to low-voltage side coil 2.

High-voltage side coil 11 is connected in parallel with high-voltage side coil 1, and disposed between low-voltage side coil 2 and low-voltage side coil 12 so as to face low-voltage side coil 12. High-voltage side coil 11 is also magnetically coupled to low-voltage side coil 12.

Figure 3:
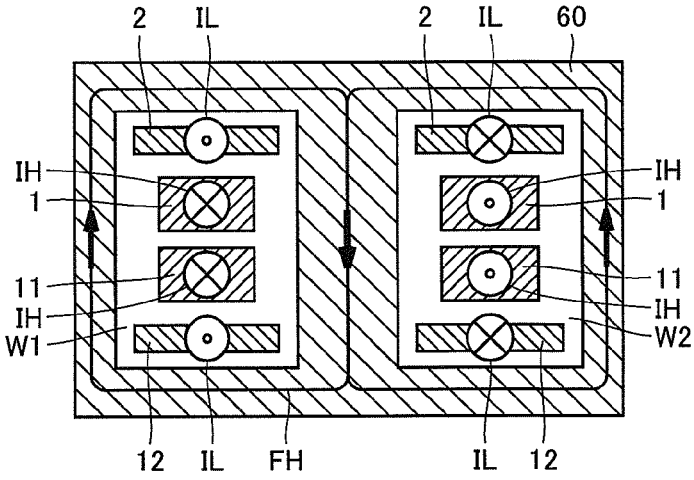
FIG. 3 is a diagram showing the cross section taken along the line of the transformer in FIG. 2 and also showing the current and the magnetic flux generated in this transformer.

FIG. 3 is a diagram showing the cross section taken along the line III-III of the transformer in FIG. 2 and also showing the current and the magnetic flux generated in this transformer.

First, an AC voltage is supplied from overhead wire 91 to pantograph 92. The AC voltage supplied from overhead wire 91 is applied through pantograph 92 to high-voltage side coils 1 and 11. This causes an AC current IH to flow through high-voltage side coils 1 and 11.

AC current IH causes generation of a main magnetic flux FH within iron core 60. Then, main magnetic flux FH also causes generation, in low-voltage side coil 2, of an AC current IL and an AC voltage in accordance with the ratio between the number of turns of low-voltage side coil 2 and the number of turns of high-voltage side coil 1. Furthermore, main magnetic flux FH causes generation, in low-voltage side coil 12, of AC current IL and an AC voltage in accordance with the ratio between the number of turns of low-voltage side coil 12 and the number of turns of high-voltage side coil 11.

In this case, the numbers of turns of low-voltage side coils 2 and 12 are smaller than the numbers of turns of high-voltage side coils 1 and 11, respectively. Accordingly, the AC voltage obtained by lowering the AC voltage applied to each of high-voltage side coils 1 and 11 is induced in low-voltage side coils 2 and 12, respectively.

The AC voltage induced in low-voltage side coil 2 is supplied to converter 5A. Furthermore, the AC voltage induced in low-voltage side coil 12 is supplied to converter 5B.

Figure 4:
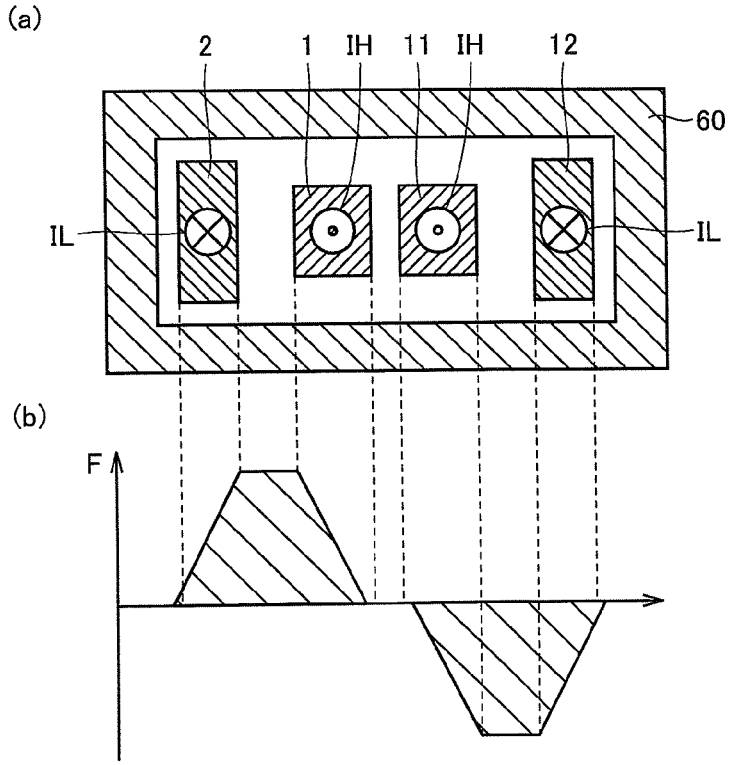
FIG. 4(*a*) is a cross sectional view of a window of the transformer through which the current generated in the transformer is shown.

FIG. 4(*a*) is a cross sectional view of a window of the transformer through which the current generated in the transformer is shown. FIG. 4(*b*) is a graph showing the leakage magnetic flux generated within the iron core in the transformer. In FIG. 4(*b*), the vertical axis indicates the magnitude of a leakage magnetic flux F.

Transformer 50 includes separate high-voltage side coils 1 and 11. In transformer 50, low-voltage side coils 2 and 12 are disposed on both sides of high-voltage side coils 1, 11, This configuration allows low-voltage side coils 2 and 12 to be magnetically loosely coupled.

In other words, as shown in FIG. 4(*b*), the leakage magnetic fluxes generated in low-voltage side coils 2 and 12 are not overlapped with each other. This allows a decrease in the magnetic interference of low-voltage side coils 2 and 12. Consequently, the output of transformer 50 can be stabilized.

In transformer 50, when the power capacity and the number of turns of the coil are increased, the number of disc windings to be stacked is increased. This causes an increase in the height of the transformer, that is, the size of the transformer in the direction in which the disc windings are stacked. Furthermore, it may also be conceivable to narrow the conductive line of the coil in order to lower the height of the transformer, which however may lead to increased power loss in the coil.

Thus, in transformer 51 described below, the coil is divided for solving the above-described problems. It is to be noted that the configuration and the operation of transformer 51 are the same as those of transformer 50 except for the features described below.

Figure 5:
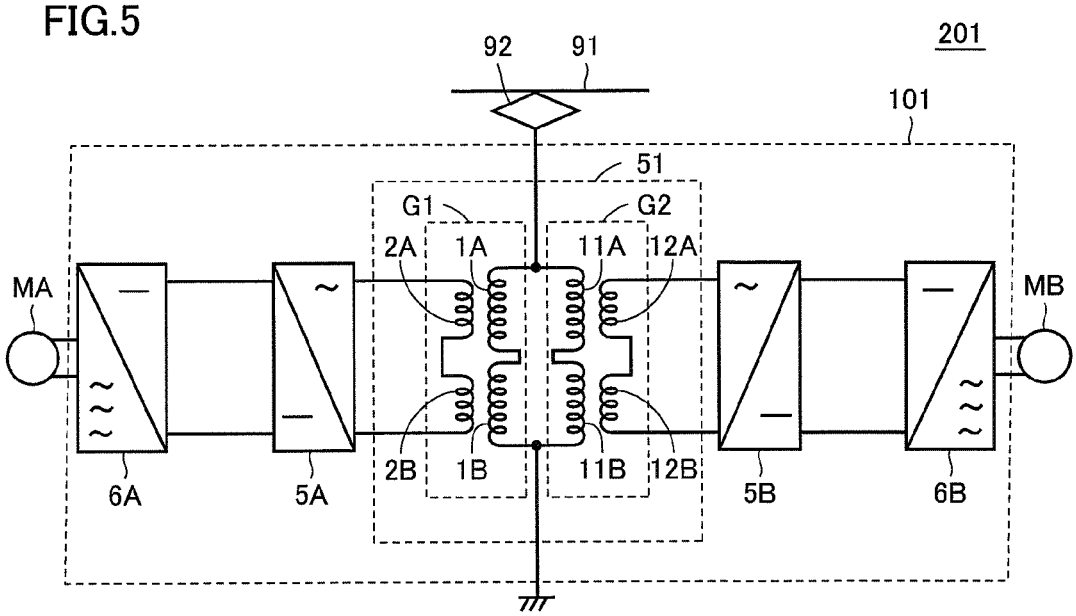
FIG. 5 is a circuit diagram showing the configuration of the AC electric train according to the first embodiment of the present invention.

FIG. 5 is a circuit diagram showing the configuration of the AC electric train according to the first embodiment of the present invention.

Referring to FIG. 5, an AC electric train 201 includes a pantograph 92, a transformation apparatus 101, and motors MA and MB. Transformation apparatus 101 includes a transformer 51, converters 5A and 5B, and inverters 6A and 6B. Transformer 51 includes coil groups G1 and G2. Coil group G1 includes high-voltage side coils 1A and 1B, and low-voltage side coils 2A and 2B. Coil group G2 includes high-voltage side coils 11A and 11B, and low-voltage side coils 12A and 12B.

In transformer 51, each coil in transformer 50 is divided into coil groups G1 and G2. In other words, high-voltage side coils 1A and 1B are obtained by dividing high-voltage side coil 1. Low-voltage side coils 2A and 2B are obtained by dividing low-voltage side coil 2. High-voltage side coils 11A and 11B are obtained by dividing high-voltage side coil 11. Low-voltage side coils 12A and 12B are obtained by dividing low-voltage side coil 12.

Pantograph 92 is connected to overhead wire 91. High-voltage side coil 1A has the first end connected to pantograph 92 and the second end. High-voltage side coil 1B has the first end connected to the second end of high-voltage side coil 1A and the second end connected to a ground node to which a ground voltage is supplied. High-voltage side coil 11A has the first end connected to pantograph 92 and the second end. High-voltage side coil 11B has the first end connected to the second end of high-voltage side coil 11A and the second end connected to the ground node to which a ground voltage is supplied.

The low-voltage side coil is provided corresponding to the high-voltage side coil, and magnetically coupled to the corresponding high-voltage side coil. In other words, low-voltage side coil 2A is magnetically coupled to high-voltage side coil 1A. Low-voltage side coil 2A also has the first end connected to the first input terminal of converter 5A and the second end. Low-voltage side coil 2B is magnetically coupled to high-voltage side coil 1B. Low-voltage side coil 2B also has the first end connected to the second end of low-voltage side coil 2A and the second end connected to the second input terminal of converter 5A. Low-voltage side coil 12A is magnetically coupled to high-voltage side coil 11A. Low-voltage side coil 12A also has the first end connected to the first input terminal of converter 5B and the second end. Low-voltage side coil 12B is magnetically coupled to high-voltage side coil 11B. Low-voltage side coil 12B also has the first end connected to the second end of low-voltage side coil 12A and the second end connected to the second input terminal of converter 5B.

The single-phase AC voltage supplied from overhead wire 91 is supplied through pantograph 92 to high-voltage side coils 1A, 1B, 11A, and 11B.

The AC voltage supplied to high-voltage side coils 1A and 11A induces an AC voltage in low-voltage side coils 2A and 12A, respectively. The AC voltage supplied to high-voltage side coils 1B and 11B induces an AC voltage in low-voltage side coils 2B and 12B, respectively.

Converter 5A converts the AC voltage induced in low-voltage side coils 2A and 2B into a DC voltage. Converter 5B converts the AC voltage induced in low-voltage side coils 12A and 12B into a DC voltage.

Inverter 6A converts the DC voltage supplied from converter 5A into a three-phase AC voltage, and outputs the voltage to motor MA. Inverter 6B converts the DC voltage supplied from converter 5B into a three-phase AC voltage, and outputs the voltage to motor MB.

Motor MA is driven based on the three-phase AC voltage supplied from inverter 6A. Motor MB is driven based on the three-phase AC voltage supplied from inverter 6B.

Figure 6:
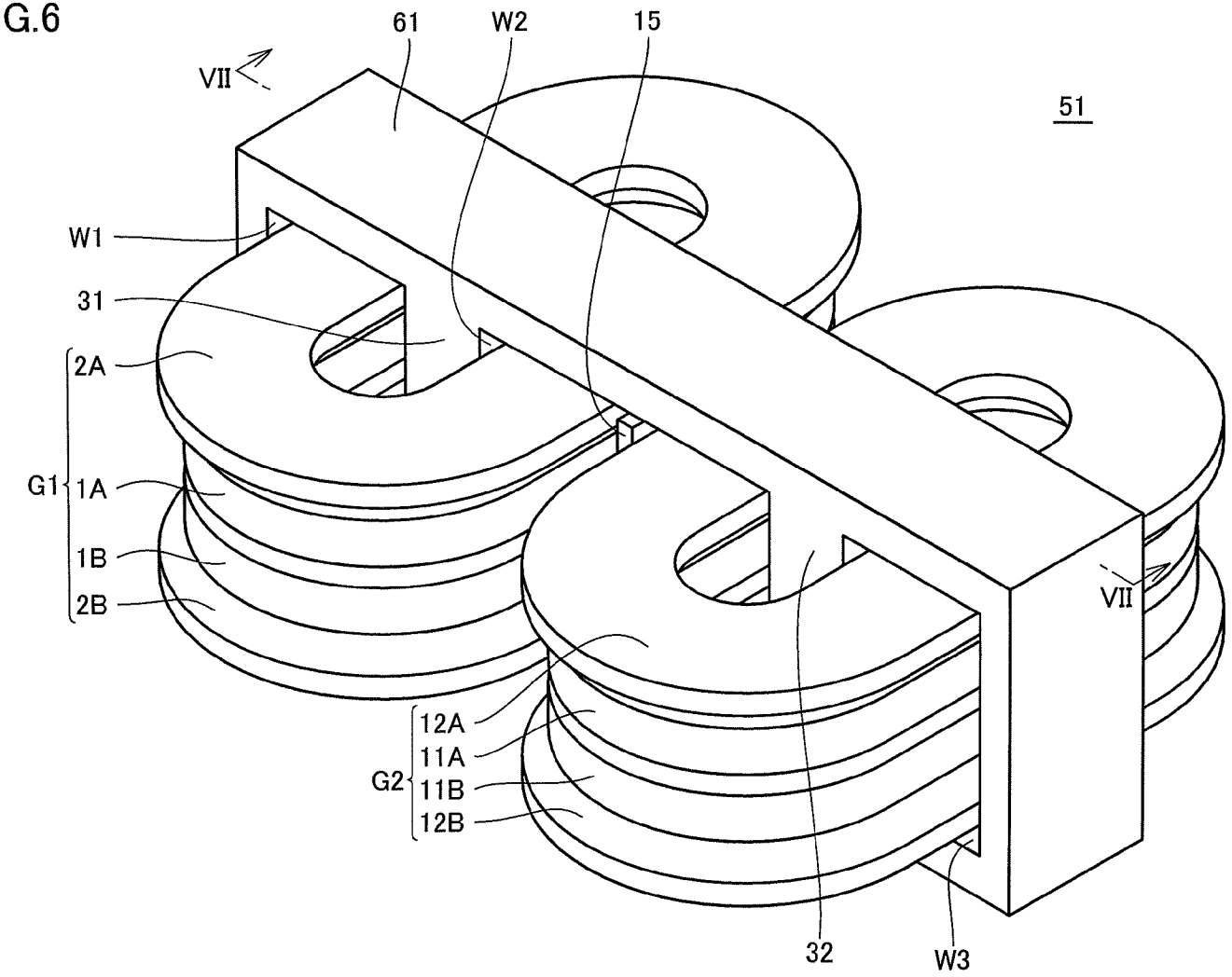
FIG. 6 is a perspective view of the configuration of the transformer according to the first embodiment of the present invention.

FIG. 6 is a perspective view of the configuration of the transformer according to the first embodiment of the present invention.

Referring to FIG. 6, transformer 51 is a shell-type transformer, for example. Transformer 51 further includes a main iron core 61 and a sub-iron core 15. Main iron core 61 has the first side surface and the second side surface facing each other, and windows W1 to W3 each penetrating from the first side surface through to the second side surface. Main iron core 61 also has legs 31 and 32 that are arranged spaced apart from each other. Leg 31 is disposed between windows W1 and W2. Leg 32 is disposed between windows W2 and W3.

Each of high-voltage side coils 1A, 1B, 11A, 11B and low-voltage side coils 2A, 2B, 12A, 12B includes a plurality of stacked disc windings in the shape of a disc, for example. The disc windings in the adjacent layers are electrically connected to each other. Each disc winding in high-voltage side coils 1A, 1B, 11A, 11B and low-voltage side coils 2A, 2B, 12A, 12B is formed by a rectangular conductive line wound in the approximately elliptical shape.

High-voltage side coil 1A is disposed between low-voltage side coil 2A and low-voltage side coil 2B so as to face low-voltage side coil 2A. High-voltage side coil 1A is also magnetically coupled to low-voltage side coil 2A.

High-voltage side coil 1B is connected in parallel with high-voltage side coil 1A, and disposed between low-voltage side coil 2A and low-voltage side coil 2B so as to face low-voltage side coil 2B. High-voltage side coil 1B is also magnetically coupled to low-voltage side coil 2B.

High-voltage side coil 11A is disposed between low-voltage side coil 12A and low-voltage side coil 12B so as to face low-voltage side coil 12A. High-voltage side coil 11 A is also magnetically coupled to low-voltage side coil 12A.

High-voltage side coil 11B is connected in parallel with high-voltage side coil 11A, and disposed between low-voltage side coil 12A and low-voltage side coil 12B so as to face low-voltage side coil 12B. High-voltage side coil 11B is also magnetically coupled to low-voltage side coil 12B.

The high-voltage side coils and the low-voltage side coils in each coil group are wound around the leg through each window located on both sides of the leg, and stacked in the direction in which the leg extends. In other words, high-voltage side coils 1A and 1B and low-voltage side coils 2A and 2B are wound through windows W1 and W2 such that the wound coils are penetrated by leg 31 between windows W1 and W2. High-voltage side coils 1A and 1B and low-voltage side coils 2A and 2B are also stacked in the direction in which leg 31 penetrates the coils. High-voltage side coils 11A and 11B and low-voltage side coils 12A and 12B are wound through windows W2 and W3 such that the wound coils are penetrated by leg 32 between windows W2 and W3. High-voltage side coils 11A and 11B and low-voltage side coils 12A and 12B are also stacked in the direction in which leg 32 penetrates the coils.

Sub-iron core 15 is disposed between coil groups G1 and G2. Main iron core 61 and sub-iron core 15 are provided separately from each other.

In this way, sub-iron core 15 is configured as an independent structure, and a gap is provided between main iron core 61 and sub-iron core 15. Consequently, sub-iron core 15 can readily be produced. Furthermore, sub-iron core 15 can be reduced in weight by the weight corresponding to the area of the gap.

Figure 7:
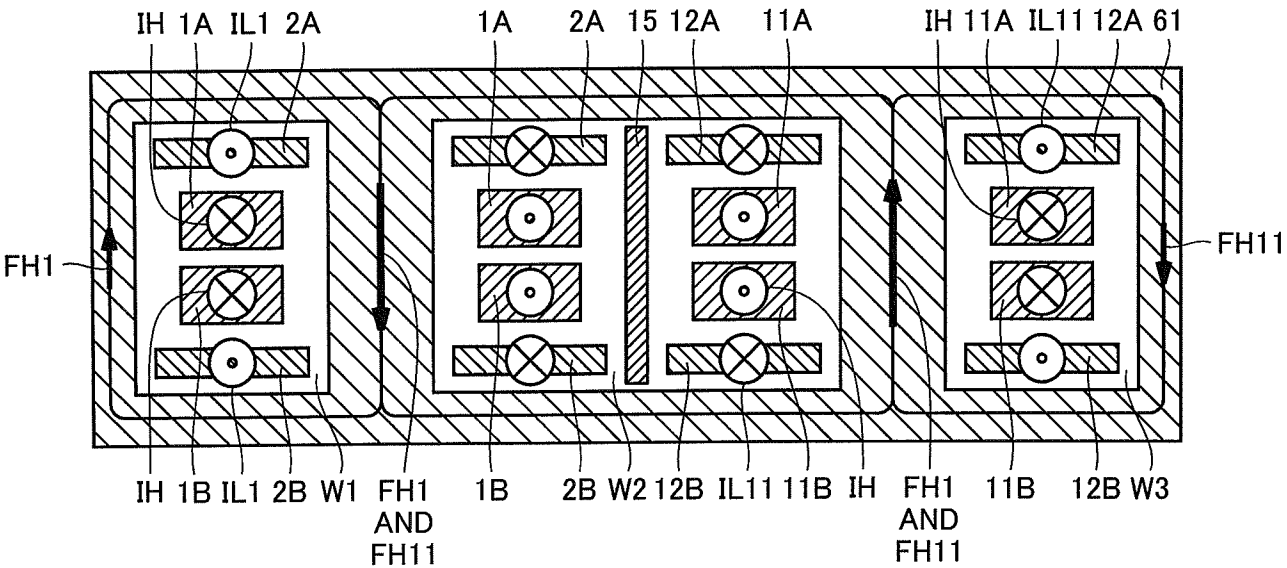
FIG. 7 is a diagram showing the cross section taken along the line VII-VII of the transformer in FIG. 6 and also showing the current and the magnetic flux generated in this transformer.

FIG. 7 is a diagram showing the cross section taken along the line VII-VII of the transformer in FIG. 6 and also showing the current and the magnetic flux generated in this transformer.

First, a single-phase AC voltage is supplied from overhead wire 91 to pantograph 92, The AC voltage supplied from overhead wire 91 is applied through pantograph 92 to high-voltage side coils 1A, 1B, 11A, and 11B. In other words, the high-voltage side coils in each coil group receive a common single-phase AC power. This causes AC current IH to flow through high-voltage side coils 1A, 1B, 11A, and 11B.

AC current IH flowing through high-voltage side coils 1A and 1B causes generation of a main magnetic flux FH1 within main iron core 61. Then, main magnetic flux FH1 also causes generation, in low-voltage side coil 2A, of an AC current IL1 and an AC voltage in accordance with the ratio between the number of turns of low-voltage side coil 2A and the number of turns of high-voltage side coil 1A. Furthermore, main magnetic flux FH1 also causes generation, in low-voltage side coil 2B, of AC current IL1 and an AC voltage in accordance with the ratio between the number of turns of low-voltage side coil 2B and the number of turns of high-voltage side coil 1B.

In this case, the number of turns of each of low-voltage side coils 2A and 2B is smaller than the number of turns of each of high-voltage side coils 1A and 1B, respectively. Accordingly, the AC voltage obtained by lowering the AC voltage applied to each of high-voltage side coils 1A and 1B is induced in low-voltage side coils 2A and 2B, respectively.

Similarly, AC current IH flowing through high-voltage side coils 11A and 11B also causes generation of a main magnetic flux FH11. Then, main magnetic flux FH11 also causes generation, in low-voltage side coil 12A, of an AC current IL11 and an AC voltage in accordance with the ratio between the number of turns of low-voltage side coil 12A and the number of turns of high-voltage side coil 11A. In addition, main magnetic flux FH11 also causes generation, in low-voltage side coil 12B, of AC current IL11 and an AC voltage in accordance with the ratio between the number of turns of low-voltage side coil 12B and the number of turns of high-voltage side coil 11B.

In this case, the number of turns of each of low-voltage side coils 12A and 12B is smaller than the number of turns of each of high-voltage side coils 11A and 11B, respectively. Accordingly, the AC voltage obtained by lowering the AC voltage applied to each of high-voltage side coils 11A and 11B is induced in low-voltage side coils 12A and 12B, respectively.

The AC voltage induced in each of low-voltage side coils 2A and 2B is supplied to converter 5A. Furthermore, the AC voltage induced in each of low-voltage side coils 12A and 12B is supplied to converter 5B.

Converter 5A converts the AC voltage supplied from low-voltage side coils 2A and 2B into a DC voltage, and outputs the voltage to inverter 6A. Converter 5B converts the AC voltage supplied from low-voltage side coils 12A and 12B into a DC voltage, and outputs the voltage to inverter 6B.

Inverter 6A converts the DC voltage supplied from converter 5A into a three-phase AC voltage, and outputs the voltage to motor MA. Inverter 6B converts the DC voltage supplied from converter 5B into a three-phase AC voltage, and outputs the voltage to motor MB.

Motor MA is rotated based on the three-phase AC voltage supplied from inverter 6A. Motor MB is also rotated based on the three-phase AC voltage supplied from inverter 6B.

Thus, in transformer 51, the low-voltage side coil and the high-voltage side coil each are divided into a plurality of coil groups, and a leg is provided for each coil group. Then, the low-voltage side coil and the high-voltage side coil in each of the plurality of coil groups are wound around a corresponding one of the legs. This configuration allows a decrease in the height of the transformer, that is, the length of the transformer in the direction in which the legs extend. The above-described configuration also eliminates the need to increase the cross-sectional area of the conductor line of the coil, with the result that the increased power loss in the coil can be prevented.

In other words, in transformer 51, since low-voltage side coils 2, 12 and high-voltage side coils 1, 11 in transformer 50 each are divided into two coil groups, the power capacity of each coil group is reduced by half. In this case, it is assumed that the voltage to be supplied is constant. When the power capacity of each coil group is reduced by half, the current flowing through each coil is also reduced by half, since power capacity=voltage×current. Therefore, since the number of disc windings to be stacked in each coil can be decreased, the height of the transformer can be lowered. Alternatively, instead of decreasing the number of disc windings, the cross-sectional area of the conductor line in each of high-voltage side coils 1A, 1B, 11A, and 11B and low-voltage side coils 2A, 2B, 12A and 12B is reduced, which causes the height of each coil group to be lowered. Consequently, the height of the entire transformer can be lowered.

Figure 8:
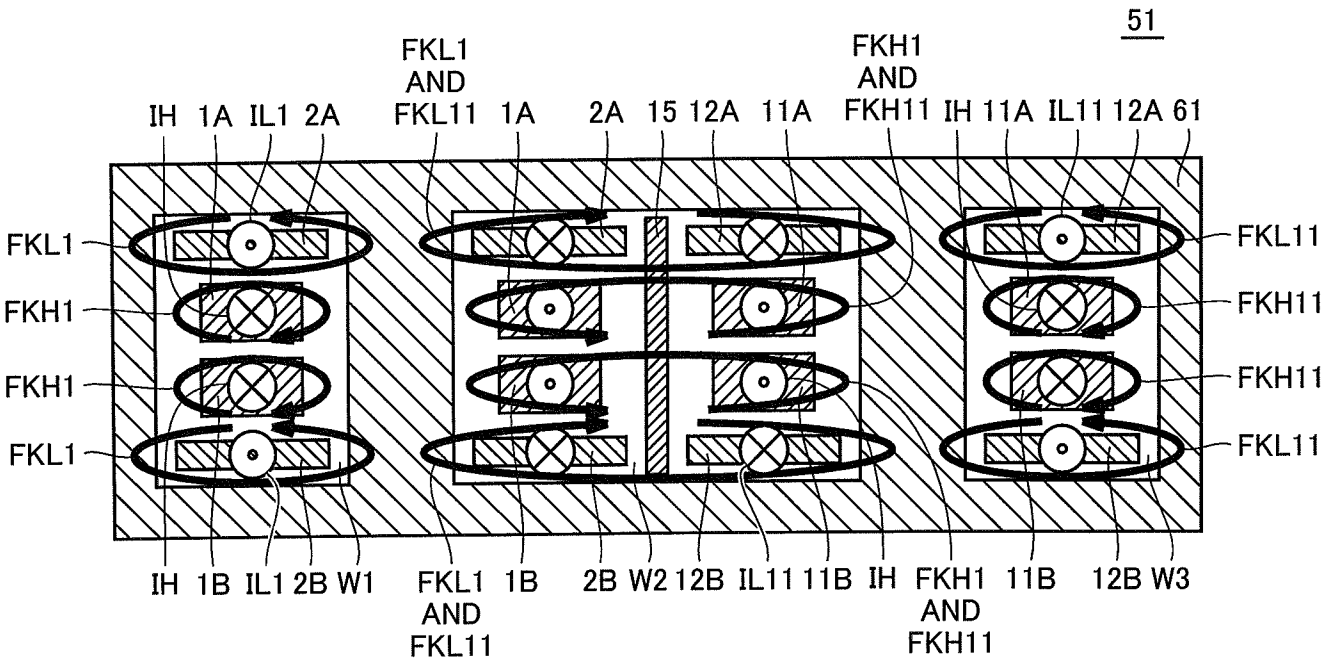
FIG. 8 is a diagram showing the leakage magnetic flux in the transformer according to the first embodiment of the present invention.

Hereinafter described will be the problems of decreased reactance in the transformer and solutions therefor. FIG. 8 is a diagram showing the leakage magnetic flux in the transformer according to the first embodiment of the present invention.

Referring to FIG. 8, in transformer 51, AC current IH flowing through the high-voltage side coils causes generation of leakage magnetic fluxes FKH1 and FKH11 that do not flow through main iron core 61, in addition to main magnetic fluxes FH1 and FH11. Furthermore, AC currents IL1 and IL11 flowing through the low-voltage side coils also cause generation of leakage magnetic fluxes FKL1 and FKL11 that do not flow through main iron core 61.

Figure 9:
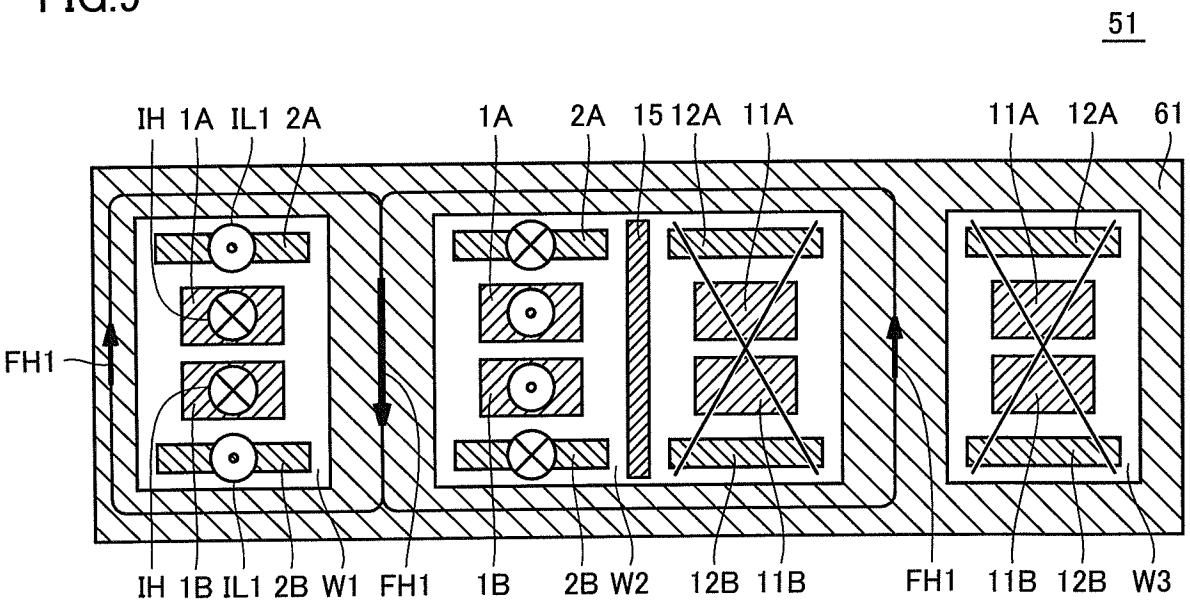
FIG. 9 is a diagram showing the main magnetic flux during the one-side operation in the transformer according to the first embodiment of the present invention.

FIG. 9 is a diagram showing the main magnetic flux during the one-side operation in the transformer according to the first embodiment of the present invention.

In transformer 51, for example, even when motor MB is faulty, motor MA can be independently operated using coil group G1. During the one-side operation as described above, high-voltage side coils 11A and 11B and low-voltage side coils 12A and 12B do not function, that is, no current flows through high-voltage side coils 11A and 11B and low-voltage side coils 12A and 12B. Consequently, main magnetic flux FH11 is not generated.

Figure 10:
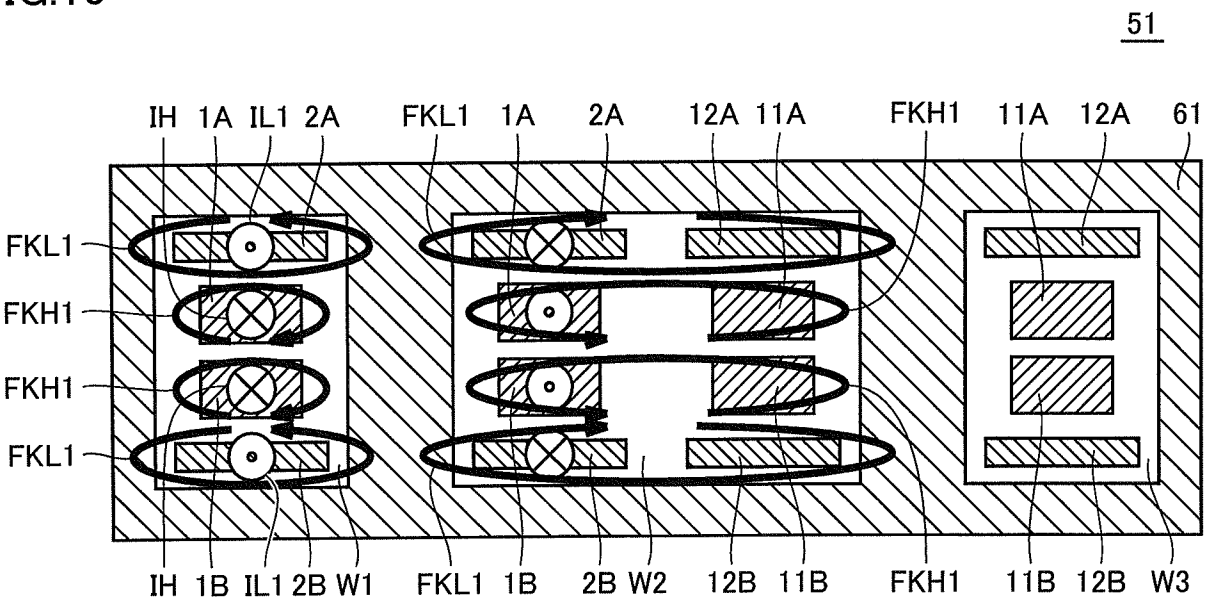
FIG. 10 is a diagram showing the leakage magnetic flux during the one-side operation in the configuration assumed that a sub-iron core is not provided in the transformer according to the first embodiment of the present invention.

FIG. 10 is a diagram showing the leakage magnetic flux during the one-side operation in the configuration assumed that a sub-iron core is not provided in the transformer according to the first embodiment of the present invention.

Referring to FIG. 10, for example, motor MB is faulty and no current flows through high-voltage side coils 11A and 11B and low-voltage side coils 12A and 12B, which prevents generation of leakage magnetic fluxes FKH11 and FKL11.

Since the transformer shown in FIG. 10 does not have sub-iron core 15, leakage magnetic fluxes FKH1 and FKL1 spread within window W2, which causes an increase in the length of the magnetic path. Therefore, as compared with the state shown in FIG. 8, the magnetomotive force in window W2 is reduced by half, that is, the magnitude of the leakage magnetic flux in window W2 is reduced by half. Consequently, the reactance of each of low-voltage side coils 2A, 2B and high-voltage side coils 1A, 1B is decreased.

In this case, the magnetic field strength is inversely proportional to the length of the magnetic path in accordance with Ampere's law. The decreased magnetic field strength means that the magnetic flux density is decreased and the self-inductance of the coil is decreased. Furthermore, the reactance is significantly influenced by the leakage inductance resulting from the leakage magnetic field. Accordingly, when the length of the magnetic path is increased, the strength of the magnetic field is decreased, thereby decreasing the self-inductance of the coil. Consequently, the leakage inductance is decreased, thereby decreasing the reactance.

In addition, during the normal operation shown in FIG. 8, leakage magnetic fluxes FKH1 and FKH11 are combined, and leakage magnetic fluxes FKL1 and FKL11 are combined, in which case the magnetomotive force in window W2 is doubled as compared with the state shown in FIG. 10. Accordingly, even in the case where the length of the magnetic path of each of leakage magnetic fluxes FKH1 and FKH11 and leakage magnetic fluxes FKL1 and FKL11 is identical to that shown in FIG. 10, the reactance of each of high-voltage side coils 1A, 1B, 11A, and 11B and low-voltage side coils 2A, 2B, 12A and 12B is not decreased.

Figure 11:
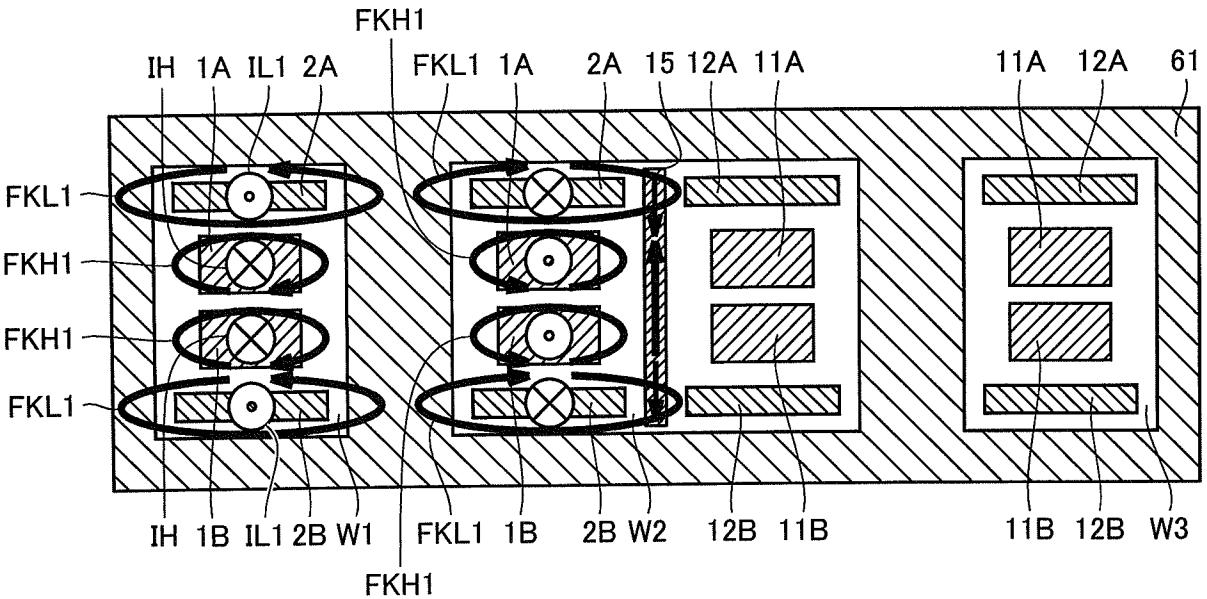
FIG. 11 is a diagram showing the leakage magnetic flux during the one-side operation in the transformer according to the first embodiment of the present invention.

FIG. 11 is a diagram showing the leakage magnetic flux during the one-side operation in the transformer according to the first embodiment of the present invention.

Referring to FIG. 11, for example, when motor MB is faulty and no current flows through high-voltage side coils 11A and 11B and low-voltage side coils 12A and 12B, leakage magnetic fluxes FKH11 and FKL11 are not generated.

Accordingly, the magnetomotive force in window W2 is reduced by half as compared with the state shown in FIG. 8. However, in transformer 51, leakage magnetic fluxes FKH1 and FKL1 flow through sub-iron core 15. This prevents leakage magnetic fluxes FKH1 and FKL1 from spreading within window W2. Accordingly, the length of the magnetic path of each of leakage magnetic fluxes FKH1 and FKL1 can be reduced by half as compared with the state shown in FIG. 10, Consequently, the reactance of each of low-voltage side coils 2A and 2B and high-voltage side coils 1A and 1B is identical to that shown in FIG. 8. Therefore, in transformer 51, even during the one-side operation, a decrease in the reactance of each of low-voltage side coils 2A and 2B and high-voltage side coils 1A and 1B can be prevented. Therefore, the stabilized reactance can be achieved.

In this case, the three-phase transformer is provided, for example, with an iron core (interphase iron core) between the coils of each phase in order to pass the main magnetic flux therethrough. In contrast, the transformer according to the first embodiment of the present invention is a single-phase transformer. The single-phase transformer is usually not required to have such an interphase iron core as provided in the three-phase transformer. However, the transformer according to the first embodiment of the present invention is provided with a sub-iron core in addition to the main iron core. Thus, for example, even when one of the motors is faulty and only the other of the motors is operated, it becomes possible to prevent the length of the magnetic path from being increased, thereby preventing a decrease in the reactance.

Then, the method of calculating the width of the sub-iron core in the transformer according to the first embodiment of the present invention will be described.

In the case where the width of sub-iron core 15 is too narrow, magnetic saturation occurs, which prevents it from functioning as an iron core. On the other hand, the width of sub-iron core 15 is too great, which causes the transformer to be increased in size. For this reason, it is preferable that the width of sub-iron core 15 is set at the minimum value which prevents saturation in the leakage magnetic flux.

In the transformer according to the first embodiment of the present invention, the minimum value of the width of sub-iron core 15, that is, the length of sub-iron core 15 in the direction in which the legs are arranged is determined based on the number of turns of the low-voltage side coil in the coil group adjacent to sub-iron core 15, the current flowing through the low-voltage side coil in the coil group adjacent to sub-iron core 15, the size of each of the low-voltage side coil and the high-voltage side coil in the coil group adjacent to sub-iron core 15, and the saturation magnetic flux density of sub-iron core 15.

Figure 12:
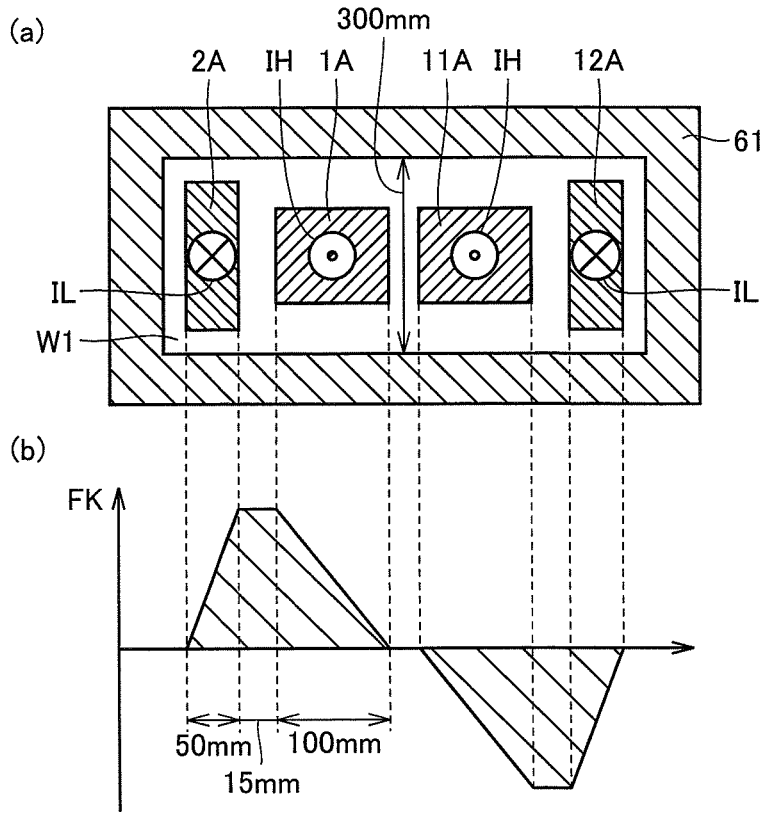
FIG. 12(*a*) is a cross sectional view of the window of the transformer through which the current generated in the transformer is shown.

FIG. 12(*a*) is a cross sectional view of the window of the transformer through which the current generated in the transformer is shown. FIG. 12(*b*) is a graph of the leakage magnetic flux generated within the iron core in the transformer. In FIG. 12 (*b*), the vertical axis shows a leakage magnetic flux density FK.

Referring to FIGS. 12(*a*) and (*b*), the calculation example of the width of the sub-iron core is as described below.

First, the number of turns M of each of low-voltage side coils 2A and 12A is set at 150; a current I flowing through each of low-voltage side coils 2A and 12A is set at 500 A (ampere); a width W of window W1 is set at 0.3 m; a height HL of each of low-voltage side coils 2A and 12A is set at 50 mm; a distance between low-voltage side coil 2A and high-voltage side coil 1A, and a distance between low-voltage side coil 12A and high-voltage side coil 11A each are set as D at 15 mm; and a height HH of each of high-voltage side coils 1A and 11A is set at 100 mm.

In addition, there is an inversely proportional relationship between the number of turns of the coil and the current flowing through the coil. In the case where the number of turns and the current of the low-voltage side coil are set at the above-described values, for example, the number of turns M of each of high-voltage side coils 1A and 11A is 500, and current I flowing through each of high-voltage side coils 1A and 11A is 150 Å (ampere). For this reason, when the number of turns and the current value of the low-voltage side coil are applied to the following equation (1), the magnetic flux density of each of high-voltage side coils 1A and 11A may be obtained.

Assuming that the space permeability is a leakage magnetic flux density BDL during the one-side operation, that is, at the time when one of motors MA and MB is operated, is represented by the following equation (1).

$$BDL=\mu\times\sqrt{2}\times M\times I/W \quad (1)$$

$$\mu=4\times\pi\times10^{7}$$

When each of the above-described values is substituted into the equation (1), the following equation is obtained.

$$BDL=4\times\pi\times10^{7}\times\sqrt{2}\times150\times500/0.3=0.444\ (\mathrm{T})$$

A magnetic flux BS flowing into the sub-iron core is a magnetic flux generated by low-voltage side coil 2A and high-voltage side coil 1A, which is equivalent to the area of the trapezoid on the left side of the graph in FIG. 12(*b*). In addition, the magnetic flux flowing into the sub-iron core becomes the strongest at the point where the magnetic fluxes generated by low-voltage side coil 2A and high-voltage side coil 1A are combined in the sub-iron core. A magnetic flux BS flowing into the sub-iron core is represented by the following equation.

$$BS=0.444\times(15+(50+15+100))/2=39.96\ (\mathrm{T\cdot mm})$$

Then, assuming that the saturation magnetic flux density of the sub-iron core (magnetic flux density of the magnetic body at the time when magnetization is hardly increased when the external magnetic field is added to the magnetic body) is BSD, a minimum value WS of the width of the sub-iron core is represented by the following equation.

$$WS=BS/BSD$$

In this case, assuming that BSD=1.5 (T), a width WS of the sub-iron core is set as described below.

$$WS=39.96/1.5=26.64\ (\mathrm{mm})$$

In other words, when the width of the sub-iron core is set at the smallest possible value of not less than 26.64 (mm), the reactance of the coil during the one-side operation can be prevented from being decreased, and the transformer can also be reduced in size.

It is to be noted that the saturation magnetic flux density is a value determined by the material properties of the sub-iron core. BSD as represented in the above-described equation is set at the small value, for example, which allows the saturation magnetic flux density to have a certain amount of margin.

As mentioned above, the transformer according to the embodiment of the present invention includes main iron core 61 having a plurality of legs arranged spaced apart from each other; high-voltage side coils 1A, 1B, 11A, and 11B wound around the plurality of legs, respectively, and receiving a common single-phase AC power, and a plurality of low-voltage side coils 2A, 12A, 2B, and 12B provided corresponding to the high-voltage side coils, magnetically coupled to the corresponding high-voltage side coils and wound around the plurality of legs, respectively. The high-voltage side coils and the corresponding low-voltage side coils constitute coil groups G1 and G2. The transformer also includes sub-iron core 15 provided between the plurality of coil groups adjacent to each other. This configuration allows the height of the transformer to be lowered and also allows prevention of a decrease in the reactance resulting from the increase in the length of the magnetic path of the leakage magnetic flux.

Other embodiments of the present invention will be hereinafter described with reference to the accompanying drawings, in which the same or corresponding components are designated by the same reference characters, and description thereof will not be repeated.

Second Embodiment

The present embodiment relates to a transformer provided with a sub-iron core having a modified structure as compared with the transformer according to the first embodiment. The features other than those described below are the same as those of the transformer according to the first embodiment.

Figure 13:
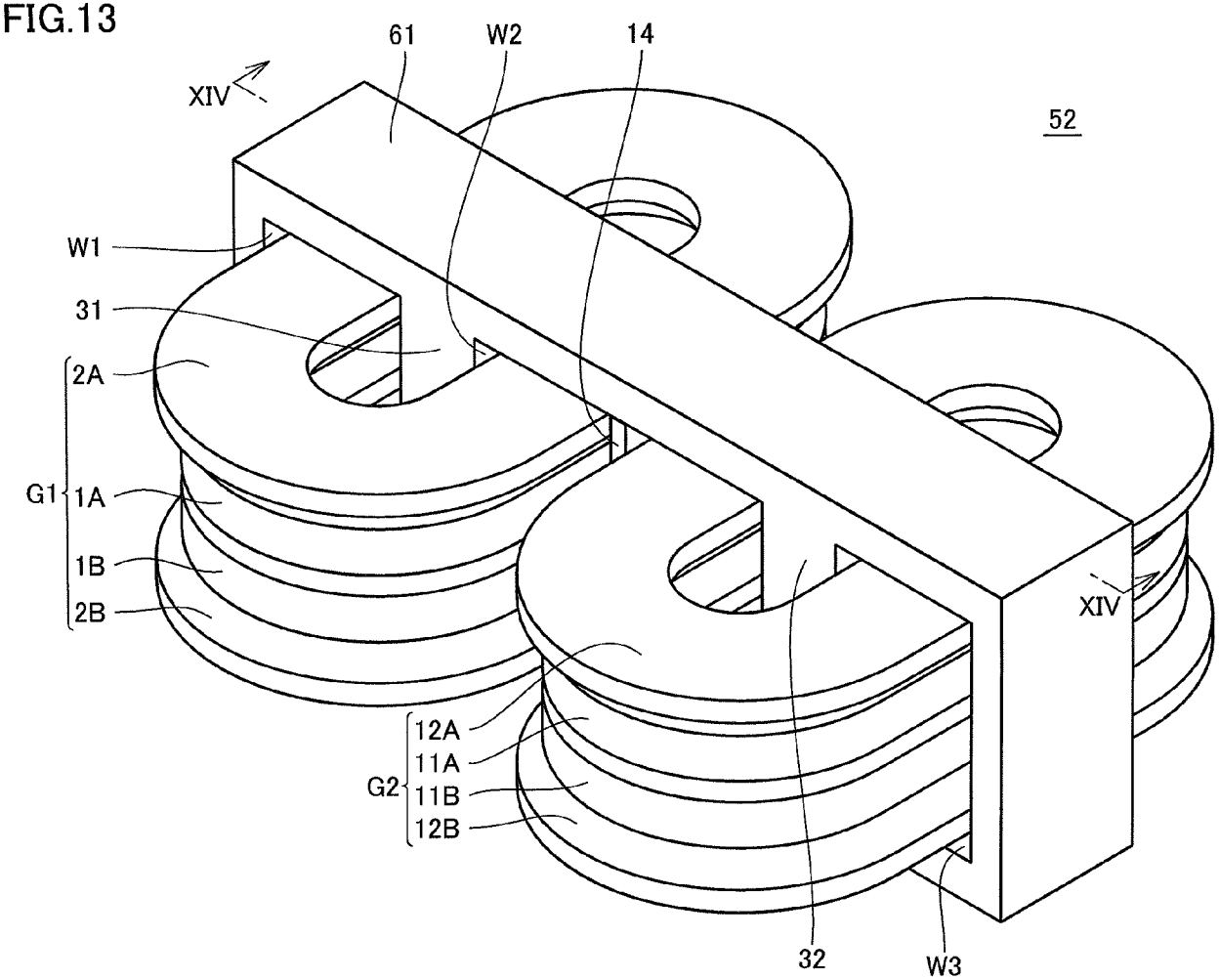
FIG. 13 is a perspective view of the configuration of a transformer according to the second embodiment of the present invention.
Figure 14:
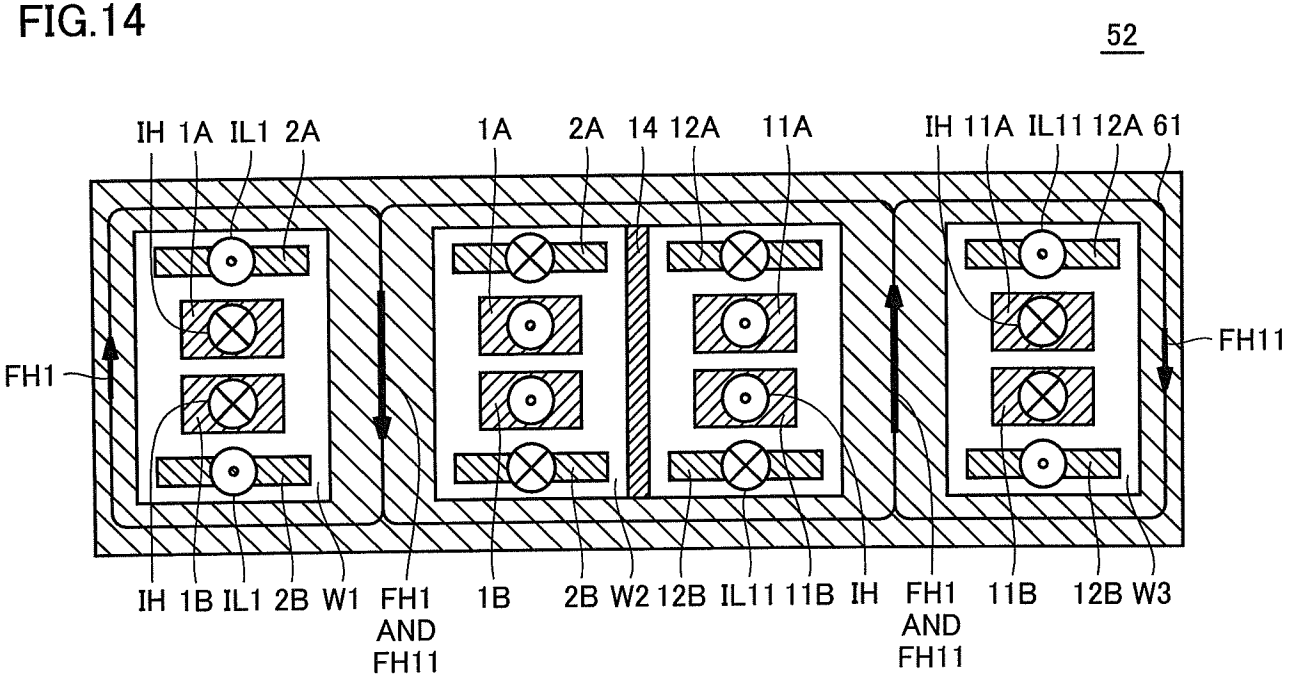
FIG. 14 is a diagram showing the cross section taken along the line XIV-XIV of the transformer in FIG. 13 and also showing the current and the magnetic flux generated in this transformer.

FIG. 13 is a perspective view of the configuration of the transformer according to the second embodiment of the present invention. FIG. 14 is a diagram showing the cross section taken along the line XIV-XIV of the transformer in FIG. 13 and also showing the current and the magnetic flux generated in this transformer.

Referring to FIGS. 13 and 14, a transformer 52 includes a sub-iron core 14 in place of sub-iron core 15 as compared with the transformer according to the first embodiment of the present invention. Sub-iron core 14 is disposed between coil groups G1 and G2, and has both ends connected to main iron core 61. In other words, sub-iron core 14 is integrated with main iron core 61.

Thus, the main iron core and the sub-iron core are integrated with each other, which eliminates a gap between the main iron core and the sub-iron core. This also allows prevention of an increase in the length of the magnetic path of the leakage magnetic flux during the one-side operation, thereby further preventing a decrease in the reactance.

Although sub-iron core 14 is configured to have both ends connected to main iron core 61, the configuration is not limited thereto, but the sub-iron core may be configured to have one end connected to the main iron core and the other end left open.

Since other configurations and operations are the same as those of the transformer according to the first embodiment, detailed description thereof will not be repeated.

Another embodiment of the present invention will be hereinafter described with reference to the accompanying drawings, in which the same or corresponding components are designated by the same reference characters, and description thereof will not be repeated.

Third Embodiment

The present embodiment relates to a transformer in which the number of dividing the coil is increased as compared with the transformer according to the first embodiment. The features other than those described below are the same as those of the transformer according to the first embodiment.

Figure 15:
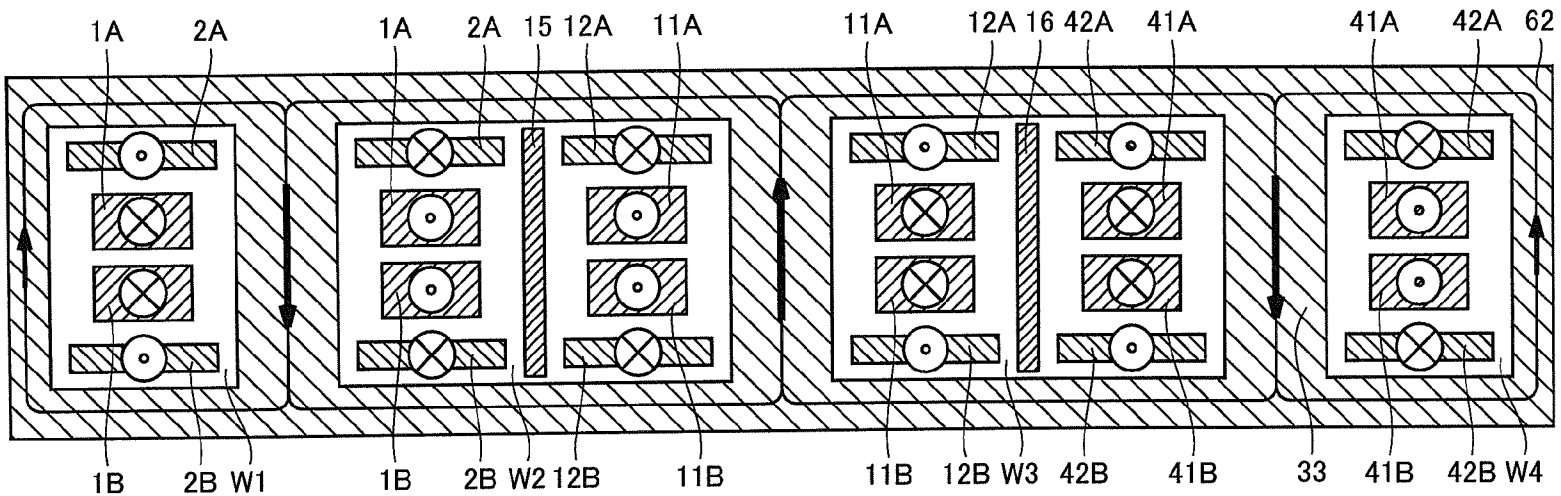
FIG. 15 is a diagram showing the configuration of a transformer according to the third embodiment of the present invention.

FIG. 15 is a diagram showing the configuration of the transformer according to the third embodiment of the present invention.

Referring to FIG. 15, a transformer 53 includes coil groups G1, G2 and G3. Coil group G1 includes high-voltage side coils 1A and 1B, and low-voltage side coils 2A and 2B. Coil group G2 includes high-voltage side coils 11A and 11B, and low-voltage side coils 12A and 12B. Coil group G3 includes high-voltage side coils 41A and 41B, and low-voltage side coils 42A and 42B.

Transformer 53 is a shell-type transformer, for example. Transformer 53 further includes a main iron core 62 and sub-iron cores 15 and 16. Main iron core 62 has the first side surface and the second side surface facing each other, and windows W1 to W4 each penetrating from the first side surface through to the second side surface. Furthermore, main iron core 62 has legs 31, 32 and 33. Leg 31 is disposed between windows W1 and W2. Leg 32 is disposed between windows W2 and W3. Leg 33 is disposed between windows W3 and W4.

Each of high-voltage side coils 41A, 41B and low-voltage side coils 42A, 42B includes a plurality of stacked disc windings in the shape of a disc, for example. The disc windings in the adjacent layers are electrically connected to each other. Each disc winding in high-voltage side coils 41A and 41B and low-voltage side coils 42A and 42B is formed by a rectangular conductive line wound in the approximately elliptical shape.

High-voltage side coil 41A is disposed between low-voltage side coil 42A and low-voltage side coil 42B so as to face low-voltage side coil 42A. High-voltage side coil 41A is also magnetically coupled to low-voltage side coil 42A.

High-voltage side coil 41B is connected in parallel with high-voltage side coil 41A, and disposed between low-voltage side coil 42A and low-voltage side coil 42B so as to face low-voltage side coil 42B. High-voltage side coil 41B is also magnetically coupled to low-voltage side coil 42B.

High-voltage side coils 41A and 41B and low-voltage side coils 42A and 42B are wound through windows W3 and W4 such that the wound coils are penetrated by leg 33 between windows W3 and W4. High-voltage side coils 41A and 41B and low-voltage side coils 42A and 42B are stacked in the direction in which leg 33 extends.

Sub-iron cores 15 and 16 are disposed between a plurality of coil groups adjacent to each other. In other words, sub-iron core 15 is disposed between coil groups G1 and G2. Sub-iron core 16 is disposed between coil groups G2 and G3.

Thus, in the transformer according to the third embodiment of the present invention, since the low-voltage side coil and the high-voltage side coil each are divided into three coil groups, the power capacity of each of the coil groups is reduced by one third. In this case, since power capacity=voltage×current, and the voltage to be applied is constant, the current flowing through each coil is reduced by one third. Consequently, the height of each coil group can be lowered, thereby lowering the height of the entire transformer, as compared with the transformer according to the first embodiment of the present invention.

Since other configurations and operations are the same as those of the transformer according to the first embodiment, detailed description thereof will not be repeated.

Still another embodiment of the present invention will be hereinafter described with reference to the accompanying drawings, in which the same or corresponding components are designated by the same reference characters, and description thereof will not be repeated.

Fourth Embodiment

The present embodiment relates to a transformer in which the number of dividing the coil is increased as compared with the transformer according to the third embodiment. The features other than those described below are the same as those of the transformer according to the third embodiment.

Figure 16:
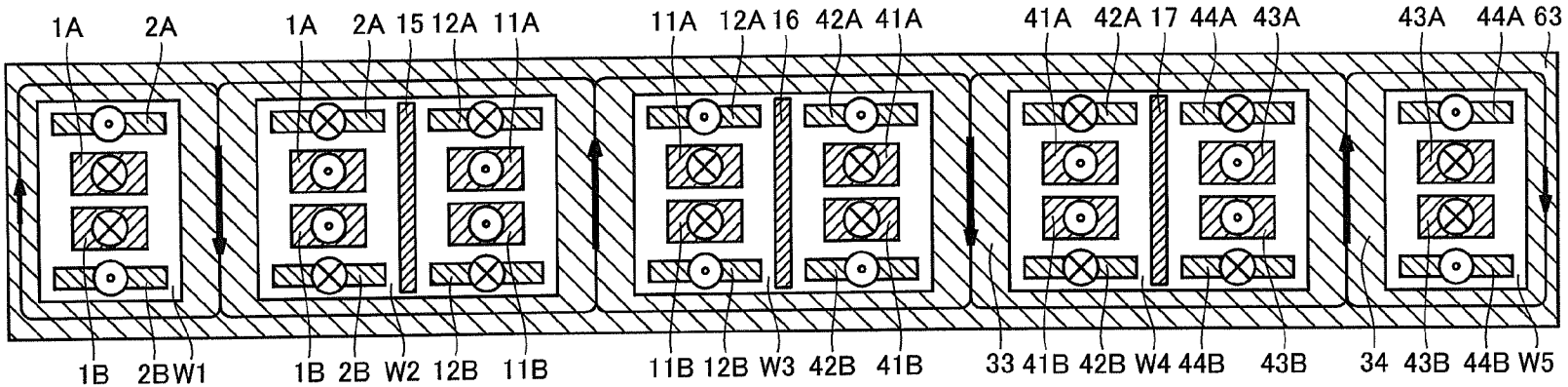
FIG. 16 is a diagram showing the configuration of a transformer according to the fourth embodiment of the present invention.

FIG. 16 is a diagram showing the configuration of the transformer according to the fourth embodiment of the present invention.

Referring to FIG. 16, a transformer 54 includes coil groups G1, G2, G3, and G4. Coil group G1 includes high-voltage side coils 1A and 1B and low-voltage side coils 2A and 2B. Coil group G2 includes high-voltage side coils 11A and 11B and low-voltage side coils 12A and 12B. Coil group G3 includes high-voltage side coils 41A and 41B and low-voltage side coils 42A and 42B. Coil group G4 includes high-voltage side coils 43A and 43B and low-voltage side coils 44A and 44B.

Transformer 54 is a shell-type transformer, for example. Transformer 54 further includes a main iron core 63 and sub-iron cores 15, 16 and 17. Main iron core 63 has the first side surface and the second side surface facing each other, and windows W1 to W5 each penetrating from the first side surface through to the second side surface. Furthermore, main iron core 63 has legs 31, 32, 33, and 34. Leg 34 is disposed between windows W4 and W5.

Each of high-voltage side coils 43A, 43B and low-voltage side coils 44A, 44B includes a plurality of stacked disc windings in the shape of a disc, for example. The disc windings in the adjacent layers are electrically connected to each other. Each disc winding in high-voltage side coils 43A and 43B and low-voltage side coils 44A and 44B is formed by a rectangular conductive line wound in the approximately elliptical shape.

High-voltage side coil 43A is disposed between low-voltage side coil 44A and low-voltage side coil 44B so as to face low-voltage side coil 44A, High-voltage side coil 43A is also magnetically coupled to low-voltage side coil 44A.

High-voltage side coil 43B is connected in parallel with high-voltage side coil 43A, and disposed between low-voltage side coil 44A and low-voltage side coil 44B so as to face low-voltage side coil 44B. High-voltage side coil 43B is also magnetically coupled to low-voltage side coil 44B.

High-voltage side coils 43A and 43B and low-voltage side coils 44A and 44B are wound through windows W4 and W5 such that the wound coils are penetrated by leg 34 between windows W4 and W5. High-voltage side coils 43A and 43B and low-voltage side coils 44A and 44B are stacked in the direction in which leg 34 extends. Sub-iron core 17 is disposed between coil groups G3 and G4.

Thus, in the transformer according to the fourth embodiment of the present invention, since the low-voltage side coil and the high-voltage side coil each are divided into four coil groups, the power capacity of each of the coil groups is reduced by one fourth. In this case, since that power capacity=voltage×current, and the voltage to be supplied is constant, the current flowing through each coil is reduced by one fourth. Accordingly, the height of each coil group can be lowered, thereby lowering the height of the entire transformer, as compared with the transformer according to the third embodiment of the present invention.

Since other configurations and operations are the same as those of the transformer according to the third embodiment, detailed description thereof will not be repeated.

Still another embodiment of the present invention will be hereinafter described with reference to the accompanying drawings, in which the same or corresponding components are designated by the same reference characters, and description thereof will not be repeated.

Fifth Embodiment

The present embodiment relates to a transformer provided with a coil group having a modified configuration as compared with the transformer according to the first embodiment. The features other than those described below are the same as those of the transformer according to the first embodiment.

Figure 17:
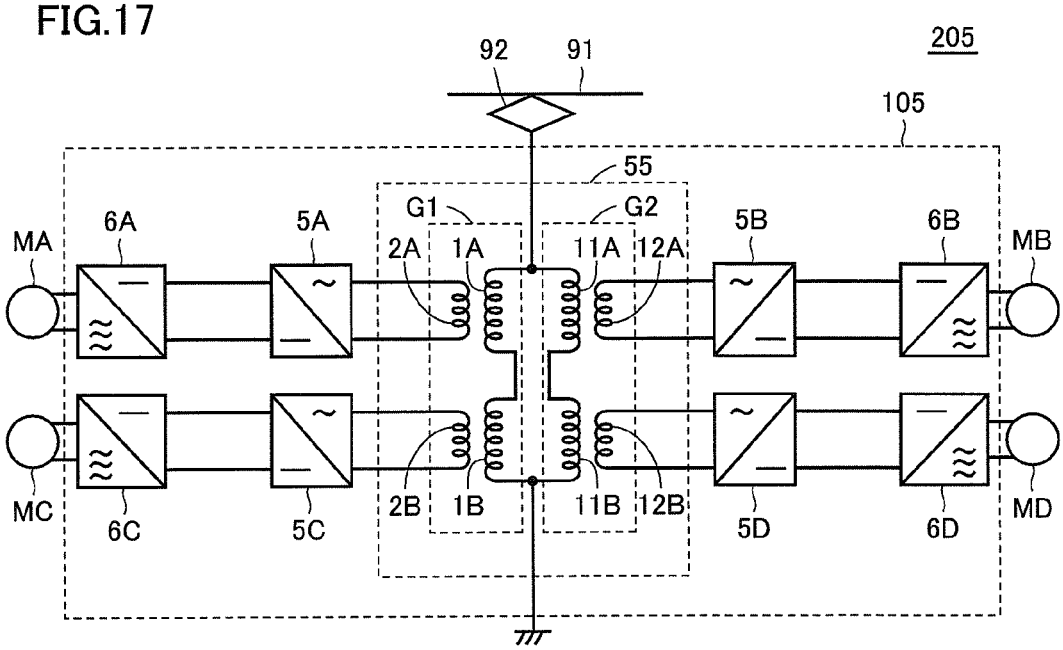
FIG. 17 is a circuit diagram showing the configuration of an AC electric train according to the fifth embodiment of the present invention.

FIG. 17 is a circuit diagram showing the configuration of an AC electric train according to the fifth embodiment of the present invention.

Referring to FIG. 17, an AC electric train 205 includes a pantograph 92, a transformation apparatus 105, and motors MA, MB, MC, and MID. Transformation apparatus 105 includes a transformer 55, converters 5A, 5B, 5C, and 5D, and inverters 6A, 6B, 6C, and 6D. Transformer 55 includes coil groups G1 and G2. Coil group G1 includes high-voltage side coils 1A and 1B and low-voltage side coils 2A and 2B. Coil group G2 includes high-voltage side coils 11A and 11B and low-voltage side coils 12A and 12B.

In transformation apparatus 105, low-voltage side coils 2A, 2B, 12A, and 12B are coupled to different loads. In other words, low-voltage side coil 2A is magnetically coupled to high-voltage side coil 1A. Low-voltage side coil 2A also has the first end connected to the first input terminal of converter 5A and the second end connected to the second input terminal of converter 5A. Low-voltage side coil 2B is magnetically coupled to high-voltage side coil 1B. Low-voltage side coil 2B also has the first end connected to the first input terminal of converter 5C and the second end connected to the second input terminal of converter 5C. Low-voltage side coil 12A is magnetically coupled to high-voltage side coil 11A. Low-voltage side coil 12A also has the first end connected to the first input terminal of converter 5B and the second end connected to the second input terminal of converter 5B. Low-voltage side coil 12B is magnetically coupled to high-voltage side coil 11B. Low-voltage side coil 12B also has the first end connected to the first input terminal of converter 5D and the second end connected to the second input terminal of converter 5D.

The single-phase AC voltage supplied from overhead wire 91 is supplied via pantograph 92 to high-voltage side coils 1A, 1B, 11A, and 11B.

The AC voltage supplied to high-voltage side coils 1A and 11A induces an AC voltage in low-voltage side coils 2A and 12A, respectively. The AC voltage supplied to high-voltage side coils 1B and 11B induces an AC voltage in low-voltage side coils 2B and 12B, respectively.

Converter 5A converts the AC voltage induced in low-voltage side coil 2A into a DC voltage. Converter 5B converts the AC voltage induced in low-voltage side coil 12A into a DC voltage. Converter 5C converts the AC voltage induced in low-voltage side coil 2B into a DC voltage. Converter 5D converts the AC voltage induced in low-voltage side coil 12B into a DC voltage.

Inverter 6A converts the DC voltage supplied from converter 5A into a three-phase AC voltage, and outputs the voltage to motor MA. Inverter 6B converts the DC voltage supplied from converter 5B into a three-phase AC voltage, and outputs the voltage to motor MB. Inverter 6C converts the DC voltage supplied from converter 5C into a three-phase AC voltage, and outputs the voltage to motor MC. Inverter 6D converts the DC voltage supplied from converter 5D into a three-phase AC voltage, and outputs the voltage to motor MD.

Motor MA is driven based on the three-phase AC voltage supplied from inverter 6A. Motor MB is driven based on the three-phase AC voltage supplied from inverter 6B. Motor MC is driven based on the three-phase AC voltage supplied from inverter 6C. Motor MD is driven based on the three-phase AC voltage supplied from inverter 6D.

Since other configurations and operations are the same as those of the transformer according to the first embodiment, detailed description thereof will not be repeated.

Therefore, in the transformer according to the fifth embodiment of the present invention, the height of the transformer can be lowered while a decrease in the reactance can be prevented, as in the transformer according to the first embodiment of the present invention.

Still another embodiment of the present invention will be hereinafter described with reference to the accompanying drawings, in which the same or corresponding components are designated by the same reference characters, and description thereof will not be repeated.

Sixth Embodiment

The present embodiment relates to a transformer provided with a coil group having a modified configuration as compared with the transformer according to the first embodiment. The features other than those described below are the same as those of the transformer according to the first embodiment.

Figure 18:
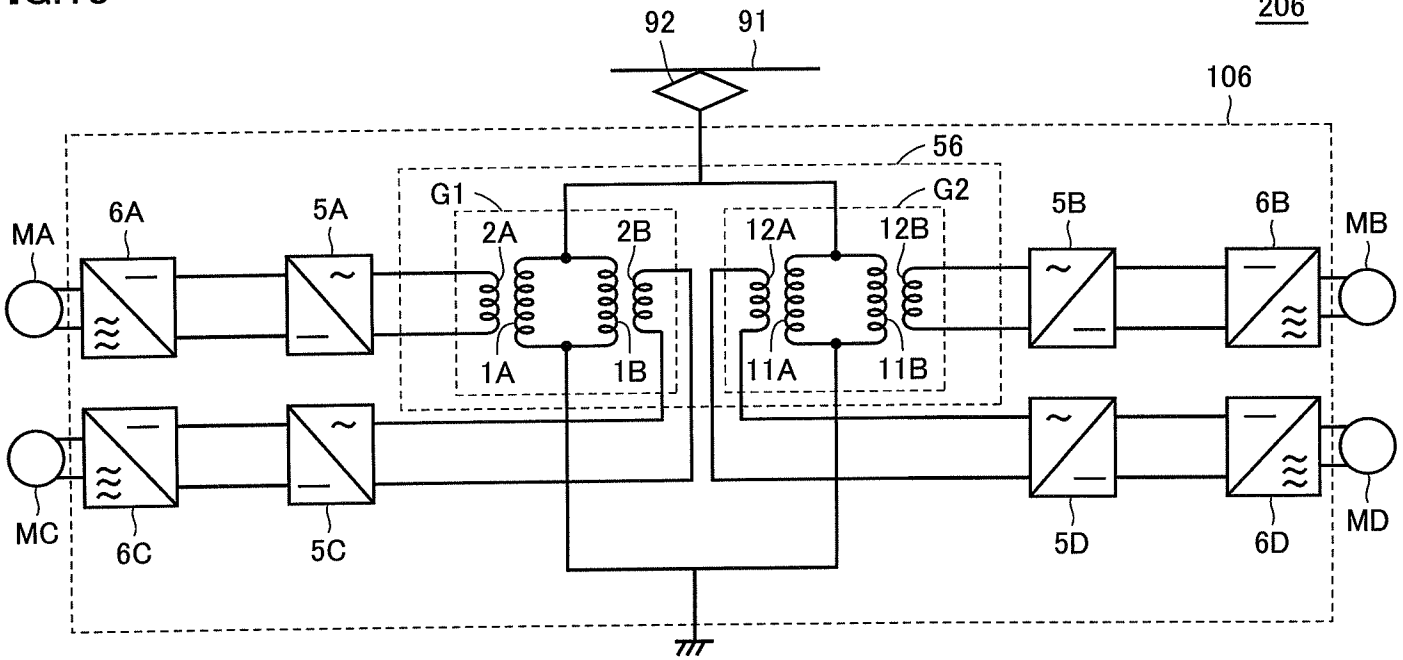
FIG. 18 is a circuit diagram showing the configuration of an AC electric train according to the sixth embodiment of the present invention.

FIG. 18 is a circuit diagram showing the configuration of an AC electric train according to the sixth embodiment of the present invention.

Referring to FIG. 18, an AC electric train 206 includes a pantograph 92, a transformation apparatus 106, and motors MA, MB, MC, and MD. Transformation apparatus 106 includes a transformer 56, converters 5A, 5B, 5C, and 5D, and inverters 6A, 6B, 6C, and 6D. Transformer 56 includes coil groups G1 and G2. Coil group G1 includes high-voltage side coils 1A and 1B, and low-voltage side coils 2A and 2B. Coil group G2 includes high-voltage side coils 11A and 11B and low-voltage side coils 12A and 12B.

In transformation apparatus 106, high-voltage side coils 1A, 1B, 11A, and 11B are connected in parallel with each other, and low-voltage side coils 2A, 2B, 12A, and 12B are coupled to different loads. In other words, high-voltage side coil 1A has the first end connected to pantograph 92 and the second end connected to a ground node to which a ground voltage is supplied. High-voltage side coil 1B has the first end connected to pantograph 92 and the second end connected to a ground node to which a ground voltage is supplied. High-voltage side coil 11A has the first end connected to pantograph 92 and the second end connected to a ground node to which a ground voltage is supplied. High-voltage side coil 11B has the first end connected to pantograph 92 and the second end connected to a ground node to which a ground voltage is supplied.

Low-voltage side coil 2A is magnetically coupled to high-voltage side coil 1A. Low-voltage side coil 2A also has the first end connected to the first input terminal of converter 5A and the second end connected to the second input terminal of converter 5A. Low-voltage side coil 2B is magnetically coupled to high-voltage side coil 1B. Low-voltage side coil 2B also has the first end connected to the first input terminal of converter 5C and the second end connected to the second input terminal of converter 5C. Low-voltage side coil 12A is magnetically coupled to high-voltage side coil 11A. Low-voltage side coil 12A also has the first end connected to the first input terminal of converter 5B and the second end connected to the second input terminal of converter 5B. Low-voltage side coil 12B is magnetically coupled to high-voltage side coil 11B. Low-voltage side coil 12B also has the first end connected to the first input terminal of converter 5D and the second end connected to the second input terminal of converter 5D.

The single-phase AC voltage supplied from overhead wire 91 is supplied via pantograph 92 to high-voltage side coils 1A, 1B, 11A, and 11B.

The AC voltage supplied to high-voltage side coils 1A and 11A induces an AC voltage in low-voltage side coils 2A and 12A, respectively. The AC voltage supplied to high-voltage side coils 1B and 11B induces an AC voltage in low-voltage side coils 2B and 12B, respectively.

Converter 5A converts the AC voltage induced in low-voltage side coil 2A into a DC voltage. Converter 5B converts the AC voltage induced in low-voltage side coil 12A into a DC voltage. Converter 5C converts the AC voltage induced in low-voltage side coil 2B into a DC voltage. Converter 5D converts the AC voltage induced in low-voltage side coil 12B into a DC voltage.

Inverter 6A converts the DC voltage supplied from converter 5A into a three-phase AC voltage, and outputs the voltage to motor MA. Inverter 6B converts the DC voltage supplied from converter 5B into a three-phase AC voltage, and outputs the voltage to motor MB. Inverter 6C converts the DC voltage supplied from converter 5C into a three-phase AC voltage, and outputs the voltage to motor MC. Inverter 6D converts the DC voltage supplied from converter 5D into a three-phase AC voltage, and outputs the voltage to motor MD.

Motor MA is driven based on the three-phase AC voltage supplied from inverter 6A. Motor MB is driven based on the three-phase AC voltage supplied from inverter 6B. Motor MC is driven based on the three-phase AC voltage supplied from inverter 6C. Motor MD is driven based on the three-phase AC voltage supplied from inverter 6D.

Since other configurations and operations are the same as those of the transformer according to the first embodiment, detailed description thereof will not be repeated.

Consequently, in the transformer according to the sixth embodiment of the present invention, the height of the transformer can be lowered while a decrease in the reactance can be prevented, as in the transformer according to the first embodiment of the present invention.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

The invention claimed is:

1. A transformer comprising:
a first iron core having a plurality of legs arranged spaced apart from each other;
a plurality of coil groups wound around said plurality of legs, respectively, each of said coil groups including
a high-voltage side coil receiving a single-phase alternating-current power being common among said coil groups; and
a low-voltage side coil magnetically coupled to said high-voltage side coil, said high-voltage side coil and said low-voltage side coil being stacked in a direction in which a corresponding leg extends; and
a second iron core provided between two coil groups of said plurality of coil groups adjacent to each other,
wherein said low-voltage side coil in each of said coil groups are coupled to different loads.

2. The transformer according to claim 1, wherein said first iron core and said second iron core are provided separately from each other.

3. The transformer according to claim 1, wherein said first iron core and said second iron core are integrated with each other.

4. The transformer according to claim 1, wherein
said first iron core has at least three openings,
said plurality of legs each are provided between two corresponding openings of said at least three openings adjacent to each other, and
said low-voltage side coil and said high-voltage side coil are wound around said corresponding leg through each of said two corresponding openings on both sides of said corresponding leg.

5. The transformer according to claim 1, wherein
a minimum value of a length of said second iron core in a direction in which said plurality of legs are arranged is determined based on a number of turns of said low-voltage side coil in a coil group selected from two coil groups adjacent to said second iron core, a current flowing through said low-voltage side coil in the selected coil group, a size of each of said low-voltage side coil and said high-voltage side coil in said selected coil group, and a saturation magnetic flux density of said iron core.

6. A transformer comprising:
a first iron core having a plurality of legs;
a high-voltage side coil; and
a low-voltage side coil,
said low-voltage side coil and said high-voltage side coil being divided into a plurality of coil groups each having a high-voltage side coil component and a low-voltage side coil component,
said plurality of coil groups being wound around said plurality of legs respectively, said high-voltage side coil component in each of said coil groups receiving a common single-phase AC power, and said low-voltage side coil component and said high-voltage side coil component in each of said coil groups being stacked in a direction in which a corresponding leg extends and magnetically coupled to each other, said transformer further comprising:

a second iron core provided between two coil groups of said plurality of coil groups adjacent to each other, wherein said low-voltage side coil in each of said coil groups are coupled to different loads.

* * * * *